US007260924B2

(12) United States Patent
Patel et al.

(10) Patent No.: US 7,260,924 B2
(45) Date of Patent: Aug. 28, 2007

(54) SEAM PINTLE FOR PAPER MAKING FABRIC

(75) Inventors: Sanjay Patel, Summerville, SC (US); Robert L. Crook, Jr., Wilson, NC (US); Bryan Wilson, Raleigh, NC (US)

(73) Assignee: Voith Fabrics, Inc., Wilson, NC (US)

( * ) Notice: Subject to any disclaimer, the term of this patent is extended or adjusted under 35 U.S.C. 154(b) by 96 days.

(21) Appl. No.: 11/043,006

(22) Filed: Jan. 25, 2005

(65) Prior Publication Data

US 2006/0162312 A1 Jul. 27, 2006

(51) Int. Cl.
*D02G 3/02* (2006.01)

(52) U.S. Cl. ..... 57/235

(58) Field of Classification Search ..... 57/233, 57/235, 260; 87/6, 7, 9
See application file for complete search history.

(56) References Cited

U.S. PATENT DOCUMENTS

| | | | | |
|---|---|---|---|---|
| 3,177,539 | A * | 4/1965 | Race | 24/33 C |
| 4,007,303 | A * | 2/1977 | Schuster et al. | 427/296 |
| 4,195,549 | A | 4/1980 | Schuster et al. | |
| 5,049,425 | A | 9/1991 | Essele | |
| 5,079,807 | A | 1/1992 | Hood | |
| 5,396,981 | A * | 3/1995 | Ohtsuji et al. | 198/659 |
| 5,503,195 | A | 4/1996 | Edens, Jr. | |
| 5,514,438 | A * | 5/1996 | Crook, Jr. | 428/57 |
| 5,585,430 | A * | 12/1996 | Patel et al. | 524/406 |
| 6,060,161 | A | 5/2000 | Aldrich | |
| 6,212,739 | B1 * | 4/2001 | Crook et al. | 24/33 P |
| 6,951,685 | B1 * | 10/2005 | Weedon et al. | 428/364 |

FOREIGN PATENT DOCUMENTS

GB 695 738 A 8/1953

OTHER PUBLICATIONS

EP Search Report, Jun. 9, 2006, Voith Fabrics Patent GmbH.
Harvey L. Stein, Ultrahigh Molecular Weight Polyethylenes (UHMWPE) Hoeschst Celanese Corporation of Charlotte, NC.
TENSYLON Chemical/Other Fluid Resistance, Synthetic Industries, Inc.

* cited by examiner

*Primary Examiner*—Shaun R. Hurley
(74) *Attorney, Agent, or Firm*—McNair Law Firm, P.A.

(57) ABSTRACT

A pintle for joining the ends of a pin-seamable paper machine fabric wherein the pintle comprises a braided sheath of an ultra high molecular weight polyethylene yarn and optionally is filled with polyamide monofilament or polyethylene yarn. The pintle is configured to substantially fill the voids in the fabric loops when inserted so that a smoother seam is achieved that significantly reduces marks on the resultant paper.

30 Claims, 4 Drawing Sheets

SEAM PINTLE FOR PAPER MAKING FABRIC

FIELD OF THE INVENTION

This invention relates to pintles for joining the ends of pin-seamable, paper making fabric together to form an endless woven fabric. The invention particularly relates to those fabrics where the ends have loops formed by the machine direction yarns which are looped and woven back into the fabric so that the insertion of a pintle will join the ends of the fabric when the loops of each end are intermeshed. More particularly, this invention relates to an improved non-porous pintle that produces a seamed fabric which substantially reduces and virtually eliminates any seam marks on the resultant paper sheet.

BACKGROUND OF THE INVENTION

A known method of joining the ends of an industrial fabric is to use a polymeric monofilament pintle wire so as to provide an endless belt. Each end of the fabric is provided with outwardly extending loops whereby the two sets of loops can be intermeshed and when aligned provide a "tunnel" for the insertion of a pintle wire. A description of such a method can be found in U.S. Pat. No. 5,079,807 entitled "Shaped Pintle Wire for Paper Machine Clothing" which issued on Jan. 14, 1992 to Paul F. Hood.

In paper production, endless belts of fabric are key components to the forming, pressing, and drying steps performed by the machines used to manufacture the paper products. One of the functions of the belts can be viewed as comparable to that served by conveyor belts because aside from serving the other key purposes of support and dewatering they carry the wet fibrous sheet along as it is being converted into a paper product.

The known monofilament pintle wires heretofore used in paper production are round in cross-section and have a low tensile strength. The wires may have flaws in the monofilament structure and, as a result, the wires often break on insertion through the tunnel defined by the loops. Even more critically, the wires may break when the belt is in operation. This can lead to belt damage and necessitates the disposal of the belt before the end of its expected working life. These belts are extremely expensive and the loss of product and production time adds even more to the expense of a separated belt. Another problem with the known monofilament wires is that the diameters of the round cross-section wires are such that they do not fill the loop area or void and as such result in a high degree of localized permeability. This, once again, is of particular importance in the field of paper making where variations and permeability in the seam result in marking of the paper product on the belt. Accordingly, it is a general object of the present invention to provide an improved pintle having properties for dealing with the foregoing mentioned problems.

As an alternate, monofilament pintle wires which comprise polyamide have been resin-treated. The resin treatment involves impregnation with phenolic or epoxy polymer resins which are then cured. Other monofilament pintle wires have been used which comprise polyamide multifilaments wrapped around a polyamide monofilament core. These known treatments and structures serve to give the polyamide multi-filament a stiffness akin to a monofilament. Resin treatment processes are a burden in terms of increased material cost and production times, as well as being increasingly environmentally unsound due to the fact that treatment with these resins requires a considerable amount of organic solvent. Furthermore, polyamides are generally lacking in abrasion resistance. Various pintle designs have been proposed to overcome some of the problems. For example, in the aforementioned patent to Hood various pintle shapes are described. In U.S. Pat. No. 5,049,425 entitled "Porous Yarn for OMS Pintles" which issued to Klaus M. Essele on Sep. 17, 1991 a pintle of braided yarn encompasses a core of monofilaments. In U.S. Pat. No. 5,503,195 entitled "Combination-Type Seaming Pintles With Wire Leader" which issued to Roy C. Edens, Jr. on Apr. 2, 1996 another pintle design is described for a papermaking fabric.

Another solution to some of the above-mentioned problems has been proposed in U.S. Pat. No. 6,060,161 which issued on Mar. 9, 2000 to William Daniel Aldrich. In the Aldrich patent a multi-filament pintle wire comprising a polyolefin material is described and a particularly preferred polyolefin is ultra high molecular weight polyethylene which is gel-spun. The gel-spun polyethylene is produced with a high degree of linear orientation and a high degree of crystallinity to give it its strength. This polyethylene is also abrasion resistant and moisture resistant.

SUMMARY OF THE INVENTION

By employing a unique combination of geometric shapes and materials a surprisingly superior pintle has been developed which is longer lasting and which prevents marks in the resultant paper by substantially filling the seam loop void and creates a virtually impermeable zone therein.

The present invention is a novel pintle structure comprising a sheath and an inner part being surrounded by said sheath wherein the inner part can be a central core of material or a hollow inner channel and at least one tape-like element forms a part of said sheath. The tape-like element has a low coefficient of surface friction being lower than that of polyamide, specifically, lower than the polyamides mentioned below as monofilament material. The sheath may be wound or braided or rolled thereby creating a pintle that has unique characteristics that allow the pintle to fill the loop space or void at the seam and provide an impermeable barrier to water flow. The preferred polymeric material itself is an improvement over the known polymers used for pintle construction which are prone to wear on the paper machine and, hence, are life limiting. In the present invention, particularly preferred is the ultra high molecular weight polyethylene yarn manufactured in tape or ribbon and fibrillated tape configurations by Synthetic Industries, Inc. of Chickamauga, Ga. under the trademark TENSYLON®.

In one preferred aspect, the present invention is a pintle for joining the ends of pin-seamable paper machine fabric together to form a pin seam, said ends having loops formed by machine direction yarns looped and woven back into the fabric so that the insertion of a pintle will join the ends of the fabric when the loops of each end are intermeshed, said pintle comprising at least one ribbon or tape-like yarn element which comprises a polymeric material; said polymeric material having a low coefficient of surface friction, improved abrasion resistance, moisture resistance and dimensional stability. The polymeric material is preferably a polyolefin and even more preferably is an ultra high molecular weight polyethylene, such as the aforementioned TENSYLON brand yarn material.

In another aspect, the present invention comprises a multiplicity of the ribbons or tape-like elements and further may comprise at least one tape-like element forming a sheath alone or in combination with a tape-like element of a different material and at least one monofilament strand filling the inner part and being surrounded by said sheath. The monofilament stand may be a polyamide such as nylon 6.6, 6.10, or 6.12 or may be polyethylene terephthalate, polypropylene or other suitable polymer. In a specific aspect of the present invention, the pintle is configured to substantially fill the seam loop void where the ends of the fabric are joined together.

In still another aspect of the invention, the pintle is braided from tape-like or ribbon elements to form a braided sheath which may be hollow or may be filled with tape-like elements alone or with a combination of tape-like elements and monofilaments. The pintle is braided from about 500 to about 700 denier ultra high molecular weight polyethylene yarn and has a finished denier in the range from about 5000 to about 9000.

In yet another aspect of the invention, strands of monofilaments, tape-like strands, or a combination of monofilaments and tape-like strands may be wrapped with a tape comprising a high molecular weight polyethylene or the tape may be rolled about the monofilaments. Furthermore, the tape-like elements preferably have a width to height ration of at least about 20:1 and more preferably about 60:1. In another aspect, the polymeric material from which the tape-like elements are formed preferably has a coefficient of friction less than 0.20, more preferably less than 0.1 and most preferably less than 0.08. In another aspect, the tensile strength of the polymeric material is preferably less than 20 g/denier. Additionally, in a further aspect, the polymeric material has an elongation of less than 10%, preferably less than 6%, and most preferably less than 3%.

The foregoing aspects of the present invention and its advantages will be more fully understood and appreciated by reference to the drawings in the detailed description which follow.

DESCRIPTION OF THE DRAWINGS

Appended hereto and made a part of this disclosure are drawings which are presented by way of illustration and not by limitation. In the drawings.

DETAILED DESCRIPTION

Figure 1:
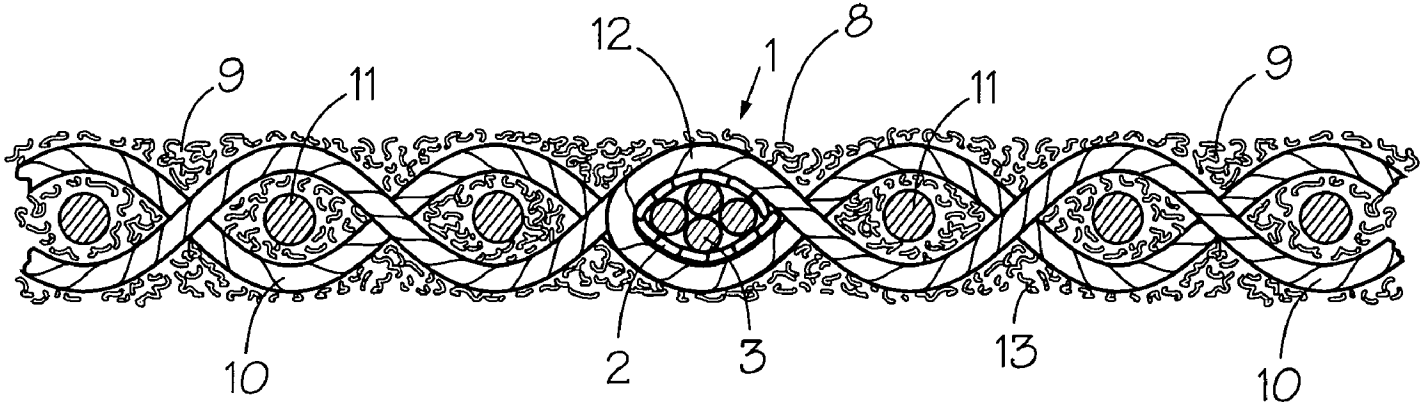
FIG. 1 is a side view of a pintle of this invention in place in the fabric used as contemplated in this invention. It is assumed that the seam is under tension and has been subjected to compression. The pintle is somewhat flattened and oblong and substantially fills the loop volume.
Figure 3:
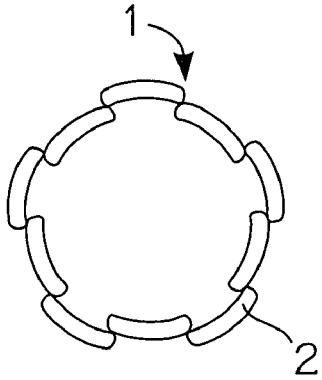
FIG. 3 shows a cross section through the braided sheath of FIG. 2 wherein the center of the sheath is a hollow core containing an inner part.
Figure 4:
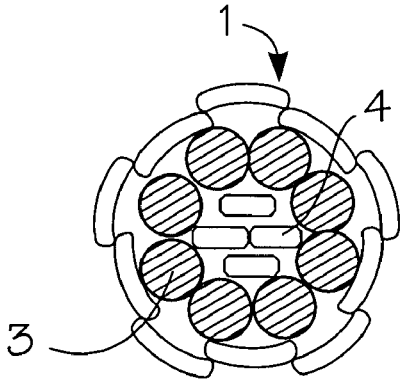
FIG. 4 shows a section of the braided sheath FIG. 2 wherein the center is filled with ribbon and monofilaments.
Figure 5:
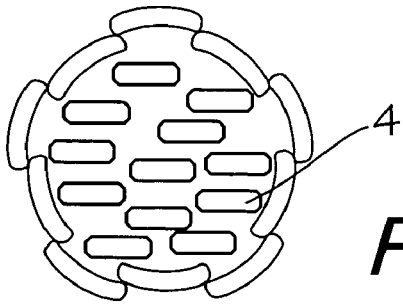
FIG. 5 shows a cross section of FIG. 2 wherein the center is filled with ribbons.
Figure 8:
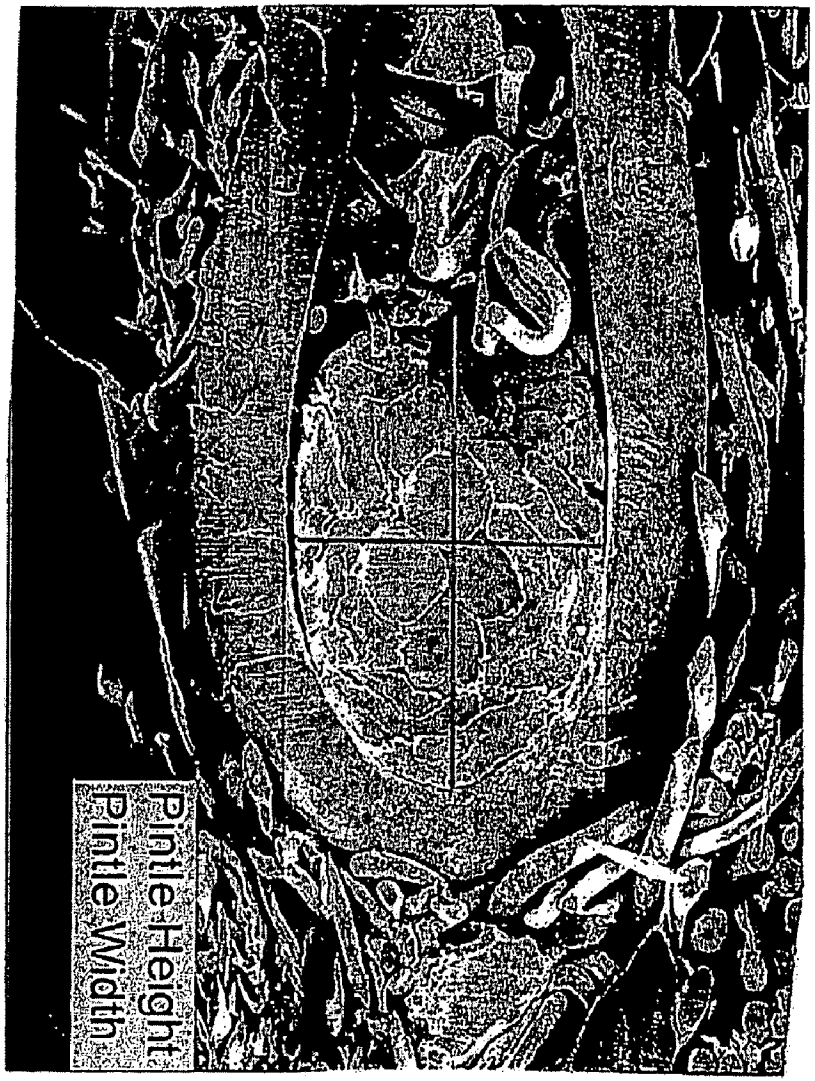

Looking first at FIG. 1, pintle 1 is shown in use by closing a pin seam 8 in the press fabric 9. Machine direction strand 10 and cross machine direction strands 11 of the press fabric 9 are also shown. The loops 12 that are used to form the pin seams 8 result from the weaving of the machine direction strands 10 back into the body of the press fabric 9 by one of several methods. A fibrous batt 13 has been needled into and through the structure of the press fabric 9. The cross section of the pintle has assumed an elliptical or oval shape or form which results from its having been subjected to compression. The pintle closely conforms to the shape of the void formed by the loops 12 leaving very little gap between pintle 1 and the loop. The structure of the pintle 1 can be seen to be closely packed and filled with the strands of ribbon 2 from which the outer sheath of the pintle is woven and with the monofilament 3 as will be described hereinafter. For convenience in illustrating, the ribbon segments are not shown as being lapped over each other in FIG. 1 as they actually are in a braided structure as shown in FIGS. 3-5. Within the sheath in FIG. 1 are monofilaments 3 which fill the core or central part of the sheath. (FIG. 8 shows how pintles according to the invention almost completely fill the loop void.) By filling the aligned voids that create a tunnel of intermeshed loops at the ends of the fabric, the pintle closely resembles the behavior of the press fabric 9 so as a result the seam 8 will be less likely to cause a mark in the paper product and will not cause any press roll vibrations.

Figure 2:
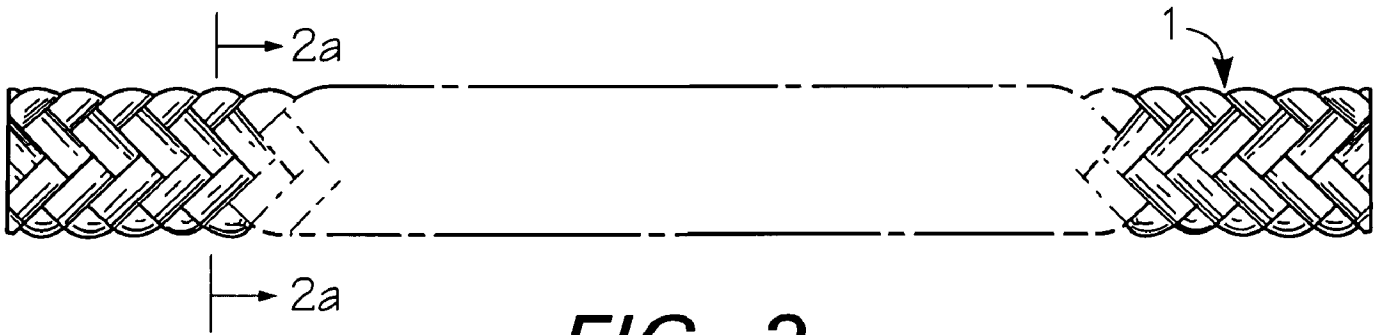
FIG. 2 shows the braided sheath of tape or ribbon yarn according to the present invention which may be hollow or may enclose ribbon or monofilament or both.

Turning now to FIG. 2, the pintle 1 of the invention will be described in greater detail so that it will be understood how the unique geometric configuration of the pintle elements and materials enable the pintle to be long lasting and to fill the loop void space at the seam and create an impermeable barrier to water flow. Pintle 1 is shown as a braided sheath which has a hollow core as shown in FIG. 3 or be filled as shown in FIGS. 4 and 5 which will be described in more detail later. Pintle 1 is braided preferably from a polyolefin ribbon or tape-like yarn such as polyethylene or polypropylene and in one embodiment is braided with ribbon of ultra high molecular weight polyethylene. In the preferred embodiments, the ultra high molecular weight polyethylene yarn is that sold under the TENSYLON trademark of Synthetic Industries Inc. as mentioned above. This material has tensile strength, dimensional stability, and surface lubricity which allows it to be readily pulled through the fabric loops. Typical diameters of the braided sheath run from about 0.039" to about 0.054". A special feature of the TENSYLON material is it can take extremely high levels of compression force and also be very smooth so that it will easily thread through the fabric loops. The tip of the preferred braided pintle can be readily compressed so that the tip can be squeezed into a standard 0.035" point of a stainless steel leader wire that is used to thread the pintle through the loops. As shown in FIG. 1 and as will be described in more detail in the description of FIGS. 2-5, the pintle 1 with the combination of the braided polyolefin sheath with the monofilament fill will tend to assume and occupy the space provided by the yarn loops so there is very little void. Consequently, in the paper making process, the compression of the nip roller will not provide a depression that would make a mark on the paper carried by the fabric nor would there be an accumulation of moisture along the seam line so that the possibility of a mark on the resultant paper is greatly diminished. In addition, the strength of the braided ribbon is such that the occurrence of breakage is significantly reduced with the consequent savings in production time and loss of product.

In FIG. 3 a cross section of the braided pintle 1 of FIG. 2 is shown with the edges of the braided ribbon 2 shown forming a sheath around inner part or hollow core 5. The pintle comprising a braided sheath with a hollow core or channel is one embodiment of the invention. The braid may be of ribbons of the same polymeric material or the ribbons can be of different materials, for example, a dimensionally stable polymer such as the ultra high molecular weight polyethylene may be woven or braided with ribbon made from a different polymer.

In FIG. 4, which is again a cross section of the pintle 1 shown in FIG. 2 with a flat strand or ribbon 2 with the braids being shown surrounding the core which is filled with monofilaments 3 and ribbons 4 for added strength and stability. Preferably the monofilaments are polyamide and these ribbons comprise a polyolefin and preferably comprise the ultra high molecular weight polyethylene yarn of the type sold under the TENSYLON brand name.

FIG. 5 shows another embodiment which is a cross section from FIG. 2 again showing the braided ribbon sheath 1 in cross section with only ribbons 4 filling the void.

Figure 2A:
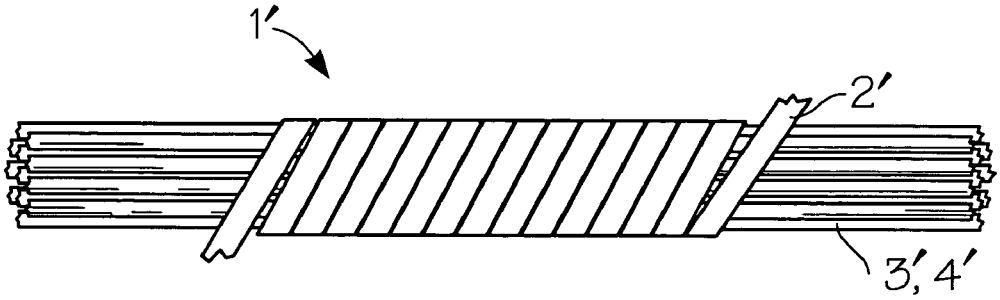
FIG. 2*a* shows monofilaments and/or ribbon wrapped by the preferred ribbon or tape of the present invention.

FIG. 2*a* shows a ribbon or tape 2' being wrapped spirally around a bundle of filler elements 3' and 4' which can be either all ribbons 4' or all monofilaments 3' or a combination of both to produce pintle 1'.

The specific geometric cross-sectional shape of the elements forming the pintle in the above embodiments is critical in that they must be shaped so they can pack into a stable shape. Round monofilament shapes or a flat tape-like or ribbon elements, or oval, rectangular, trapezoidal, hexagonal or other typical geometric variations may be found useful as long as the nature of the material and the resultant pintle are capable of conforming to the surrounding loop geometry in a stable park. This is a significant feature of the present invention. The polyolefin tape or ribbon gives a densely packed pintle that is easy to install yet remains impermeable in situ and hence restricts the flow of water that would ordinarily result in different hydraulic marking in the dynamic conditions in the paper making machine. As shown in the embodiments above, the preferred structures can be formed by braiding, winding or even rolling a tape around the bundle of monofilaments that form the inner part.

Figure 6:
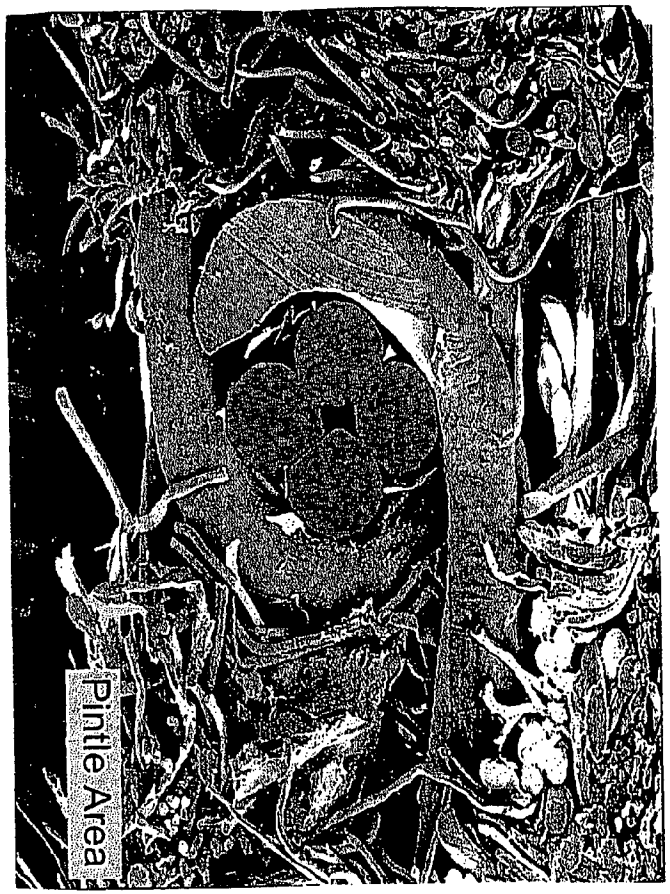
FIG. 6 is a blown up photograph of a section through a loop of paper making fabric showing a pintle of four monofilaments in the loop void and illustrates the pintle area representing a prior art pintle.
Figure 7:
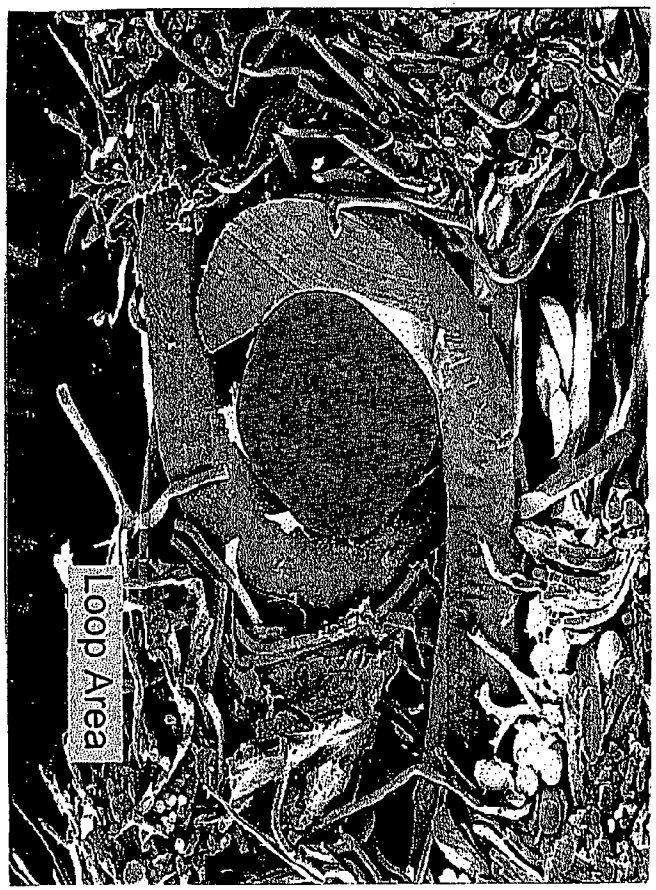
FIG. 7 is a blown up photograph of a section showing a seam loop void and illustrating the loop area; and, FIG. 8 is a blown up photograph of a section showing a seam loop void filled with a pintle of the invention after use in a production process illustrating the filled loop void.

While the geometric configuration of the pintle elements is important to ensure a stable packing, so also is the material selected as these shapes and material properties tend to complement each other. Two methods of evaluating the effectiveness of a pintle design are to determine the percentage of pintle contact with the perimeter of the loop and to determine the loop void ratio. These are quantitative measures of how well the pintle fills the loop void while in use. The pintle's contact with the loop refers to the portion of the interior perimeter of the loop is contacted by the pintle. This can be appreciated from FIG. 6, which is a blown-up photograph of a loop in a paper making fabric with a pintle of four monofilaments in the loop void area which is approximated closely as an ellipse as the width is greater than the height (See FIG. 8, for example). The dark central area of FIG. 7 illustrates the initial loop area so that the cross-sectional area of the four monofilaments in FIG. 6 represents the pintle area and the dark central area represents the loop void area. Thus, the seam loop filling percentage or void ratio is=pintle area/loop void area×100. It is preferred that the void ratio be at least 80%.

The pintle contact with the loop is calculated by measuring or calculating the length of the perimeter of the loop. This measurement is the denominator and the numerator in the fraction is the length of perimeter contact by the pintle. That is, pintle contact percentage=pintle contact length/loop perimeter length×100. The importance of these parameters is that a filled void gives more dimensional stability, provides a smoother seam, and reduces surface friction and hence wear between the loop and pintle. It is preferred that the contact ratio be at least 60%.

FIG. 8 shows a pintle of a preferred embodiment of the present invention after use and the pintle area is substantially filled. The end views of four round monofilaments are shown located in the center. The remaining loop area is filled by the braided sheath whose strands are shown in end view and appear as oblong in shape. A horizontal and a vertical line are also shown as an indicator of width and height and the greater width indicates the oval or oblong shape as opposed to an original circular shape. FIG. 8 illustrates how well these geometric shapes pack together to form a stable slope.

In a first test using a production run, measurements were made of pintle area from results after actual use. The loop void ratio range was 84-92% and the perimeter contact range was 93-95% for a pintle according to the present invention. By contrast in a four strand monofilament pintle of the prior art, the void ratio was in the range of 50-46% and the pintle contact 86-92% for the perimeter coverage. In a second test, the contact perimeter coverage was 60% greater for the pintles according to the present invention than for the four strand standard monofilament. Likewise, in a loop breaking test, conventional, prior art pintles of four monofilament broke at 359 and 365 pounds force whereas a pintle, according to the present invention, broke at about 406 pounds force. In addition, it is preferred that the coefficient of friction for the tape-like polymeric material be lower than 0.2, preferably less than 0.1 and most preferably less than 0.08. It is also preferred that the polymeric material have a tenacity of less than 18 g/denier.

BEST MODE EXAMPLE

To make a best mode of the invention, light yarns of split film of ultra high molecular weight polyethylene fiber (TENSYLON yarn) of about 700 denier each are braided in a sheath and are filled with an inner part of monofilaments of 0.30 mm nylon 6 to produce a pintle having a total mass in the range of about 5000 to about 9000 denier. In FIG. 1 this arrangement is shown where pintle 1 comprises a sheath 2 where edges 3 are shown with monofilament 2 comprising the inner part.

The feature that sets the TENSYLON yarn apart from other UHMWPE's is the method by which it is made which gives it its very low coefficient of friction, abrasive resistance dimensional stability. The characteristics have been discovered to be uniquely beneficial to the pintle design of the present invention. Coupled with the novel geometric configuration of this invention a new and very useful pintle has been developed. The tape or ribbon aspect ratio should be greater than 20:1 (width to height) and a preferred interior is 60:1. Incorporated by reference herein is the article by Harvey L. Stein on UHMWPE by Hoescht Celanese of Charlotte, N.C. from the manufacturer of TENSYLON which are cited in the accompanying Information Disclosure Statement. A preferred alternate material for the tape-like polymers elements is polytetrafluoroethylene or PTFE.

While a preferred embodiment of the invention has been described using specific terms, such description is for illustrative purposes only, and it is to be understood that changes and variations may be made without departing from the spirit or scope of the following claims.

We claim:

1. A pintle for joining the ends of a pin-seamable, paper machine fabric together to form a pin seam, said ends having loops so that the insertion of a pintle into the void formed by the loops will join the ends of the fabric when the loops of each end are intermeshed, said pintle comprising:

a) a sheath and an inner part surrounded by said sheath;

b) at least one tape-like elongated element forming at least a part of said sheath;

c) said tape-like element comprising a polymeric material having an unlubricated, surface coefficient of friction lower than 0.20.

2. The pintle of claim 1 wherein the pintle comprises a multiplicity of elongated tape-like elements forming at least part of said sheath.

3. The pintle of claim 1 wherein said sheath has a braided construction.

4. The pintle of claim 1 wherein said sheath has a wrapped construction.

5. The pintle of claim 1 wherein said sheath has a rolled construction.

6. The pintle of claim 1 wherein the tape-like element has a width to height ratio of at least as great as about 20:1.

7. The pintle of claim 1 wherein said pintle is configured to fill at least 80% of the volume of a seam loop void into which it may be inserted.

8. The pintle of claim 1 wherein said pintle is configured to contact at least 60% of the surface of a seam loop into which it may be inserted.

9. The pintle of claim 1 wherein said pintle is configured to substantially fill a seam loop into which it is inserted whereby the void is impermeable to fluids.

10. The pintle of claim 1 wherein said inner part is empty.

11. The pintle of claim 1 wherein said inner part is filled with a filler material.

12. The pintle of claim 11 wherein said filler material comprises at least one elongated tape-like element.

13. The pintle of claim 12 wherein said elongated tape-like element comprises polyolefin material.

14. The pintle of claim 12 wherein said filler material comprises at least one polyamide monofilament.

15. The pintle of claim 1 wherein the polymeric material has a coefficient of friction lower than about 0.1.

16. The pintle of claim 1 wherein the polymeric material has a coefficient of friction lower than about 0.08.

17. The pintle of claim 1 wherein the polymeric material has an elongation of less than 10%.

18. The pintle of claim 1 wherein the polymeric material has a tenacity of less than 18 g/denier.

19. The pintle of claim 1 wherein the polymeric material comprises PTFE.

20. The pintle of claim 1 wherein the polymeric material comprises polyolefin material.

21. The pintle of claim 20 wherein the polyolefin is an ultra high molecular weight polyethylene.

22. The pintle of claim 21 wherein the ultra high molecular weight polyethylene is the yarn which is identified by the trademark TENSYLON®.

23. The pintle of claim 1 wherein the pintle comprises at least one tape-like element and at least one monofilament strand.

24. The pintle of claim 23 wherein said monofilament strand comprises a polyamide.

25. The pintle of claim 3 wherein said pintle comprises at least two braided sheaths twisted together to form a single pintle.

26. The pintle of claim 22 wherein said yarn is braided.

27. The pintle of claim 22 wherein said yarn ranges from about 500 to about 700 denier.

28. The pintle of claim 22 wherein the polymeric yarn comprises a combination of TENSYLON yarn and polyamide monofilaments.

29. The pintle of claim 28 wherein the polymeric yarn ranges from about 5000 to about 7000 denier.

30. The pintle of claim 24 comprising an outer part of a braided sheath of ultra high molecular weight polyethylene ribbon, and an inner part comprising polyamide monofilaments.

* * * * *